US005291616A

United States Patent [19]

Lamons et al.

[11] Patent Number: 5,291,616

[45] Date of Patent: Mar. 8, 1994

[54] WAISTBAND ACCESSORY DEVICE AND WRAPPING METHOD USING A SCARF AND A SCARF SHAPER FORM

[76] Inventors: Susan B. Lamons, 140 Goodall Ave., Daytona Beach, Fla. 32118; Lisa A. Rhoades, 522 N. Sands Souci Ave., Deland, Fla. 32720

[21] Appl. No.: 11,441

[22] Filed: Jan. 29, 1993

[51] Int. Cl.[5] ..... A41D 27/00

[52] U.S. Cl. ..... 2/311; 2/144; 2/279; 2/244; 2/207; 2/338

[58] Field of Search ..... 2/91, 171, 207, 310, 2/311, 244, 338, 279, 144, 137, 138; 63/1, 2, 9, 13; D11/1, 2, 200, 202, 203, 204, 205

[56] References Cited

U.S. PATENT DOCUMENTS

| | | | |
|---|---|---|---|
| 594,201 | 11/1897 | Frothingham | 2/338 |
| 644,557 | 2/1900 | Koch | 2/311 |
| 648,267 | 4/1900 | Koch | 2/311 |
| 1,725,998 | 8/1929 | Rockwood | 2/338 |
| 3,530,031 | 9/1970 | Loen | 2/338 |
| 3,618,140 | 11/1971 | Goldfarb | 2/207 |
| 4,144,594 | 3/1979 | Chapman | 2/338 |
| 5,058,211 | 10/1991 | Hanks | 2/207 X |

FOREIGN PATENT DOCUMENTS

| | | | |
|---|---|---|---|
| 48164 | 12/1910 | Austria | 2/311 |
| 431963 | 7/1935 | United Kingdom | 2/171 |

*Primary Examiner*—Clifford D. Crowder
*Assistant Examiner*—Jeanette E. Chapman
*Attorney, Agent, or Firm*—Sprung Horn Kramer & Woods

[57] ABSTRACT

A waistband adapted to surround the waist of a wearer as a fashion accessory comprises both a scarf and a semi-rigid form made of flexible sheet material. The scarf covers and is wrapped about at least a portion of the form, when in use as a waistband, with the form disposed at the midsection of the wearer. The scarf thus takes on a shape defined in part by the form.

16 Claims, 4 Drawing Sheets

WAISTBAND ACCESSORY DEVICE AND WRAPPING METHOD USING A SCARF AND A SCARF SHAPER FORM

BACKGROUND OF THE INVENTION

The present invention relates to a women's waistband accessory device and a method of forming this waistband. The device and method utilize a scarf or similar fabric accessory formed of a piece of cloth and a separate, semi-rigid form made of flexible sheet material.

It is known in the prior art to provide all manner of attractive waistbands as accessories to women's clothing. Normally belts of leather, simulated leather, heavy cloth or a semi-rigid flexible material covered with cloth are used as a waistband. The belts are made with sufficient rigidity to maintain their width around the waist of the wearer.

An example of an extremely wide belt, at least in its front portion, is a cumberbund. A cumberbund is normally made of semi-rigid material covered with cloth and sewn together as a unit. The cloth portion exposed to view at the front of the wearer may be pleated. The U.S. Pat. No. 2,574,678 of R. N. Wilbur discloses one type of cumberbund which is designed to give the wearer a slim waistline and a sleek figure.

Scarfs have also been used as attractive waistbands, usually by wrapping them around the waist and tying their ends together either at the front, side or back of the wearer. Examples of such a use of the scarf are disclosed in the U.S. Pat. Nos. 3,380,076 to Held and 3,605,121 to Suzuki The French Patent No. 990,349 to Cooley also teaches the use of a scarf as a waistband.

As used herein, the term "scarf" is intended to mean a broad band of cloth, usually of extremely fine woven and thin material, of such a size and shape as to enable it to be worn about the shoulders, around the neck or over the head of a woman as a fashion accessory. Due to the thinness of the material, it is extremely flexible and tends to adapt itself readily to the shape (body part or the like) with which it comes in contact.

As a consequence, when a scarf is used to form a waistband as a fashion accessory, it tends to reduce its diameter into an insignificant narrow tie around the waist, even though initially it may have been arranged about the waist spread wide like a cumberbund. Heretofore, it has not been possible to maintain the width of a scarf, when used as a waistband, in the manner of a belt or cumberbund.

SUMMARY OF THE INVENTION

It is therefore a principal object of the present invention to provide a waistband, adapted to surround the waist of a wearer as a fashion accessory, which utilizes a conventional scarf, formed of a piece of cloth material, and which can be shaped to remain at any desired width around the waist of the wearer.

This object, as well as further objects which will become apparent from the discussion that follows, are achieved, in accordance with the present invention, by providing at least one semi-rigid form made of flexible sheet material, such as plastic or cardboard, and by wrapping the scarf about at least a portion of this form to create a waistband, with the form disposed at the front midsection of the wearer. With this arrangement, the scarf takes on a shape defined in part by the form and maintains its width as a waistband.

For a full understanding of the present invention, reference should now be made to the following detailed description of the preferred embodiments of the invention as illustrated in the accompanying drawings.

DESCRIPTION OF THE PREFERRED EMBODIMENTS

Figure 1A:
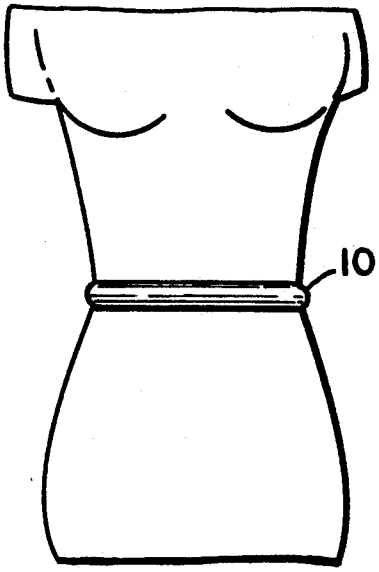
FIG.1A PRIOR ART
FIGS. 1A and 1B are elevational views showing the front and back, respectively, of a woman wearing a waistband formed of a scarf as it is known in the prior art.

The preferred embodiments of the present invention will now be described with reference to FIGS. 1–16 of the drawings. Identical elements in the various figures are identified by the same reference numerals.

Figure 1B:
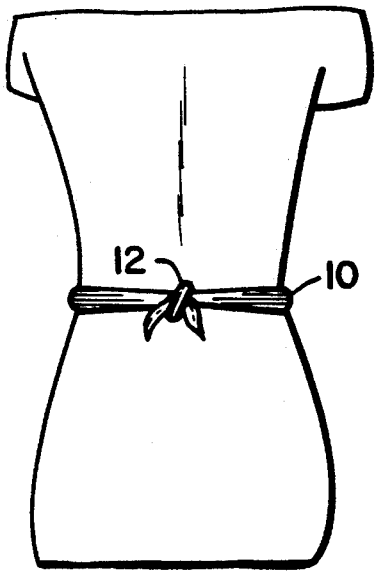
FIG.1B PRIOR ART

FIGS. 1A and 1B illustrate how a scarf 10 is conventionally worn by a woman as a decorative waistband. The scarf is folded and then formed into a tubular shape, e.g., by rolling or simply by pulling the opposite ends apart. The tubular shaped scarf is then wrapped around the waist and tied in the back with a knot 12. Alternatively, the knot can be placed at the side or the front, to create different "looks" or styles. If the scarf is long enough, it can be wrapped twice about the torso.

As is illustrated in FIGS. 1A and 1B, the scarf 10 assumes an insignificant narrow line around the waist. Although a scarf is normally decorative in its design and colors, such decorative qualities are substantially hidden from view in this waistband configuration. Up to now it has not been possible to take advantage of these decorative qualities of a scarf when it is used as a waistband.

Figure 2:
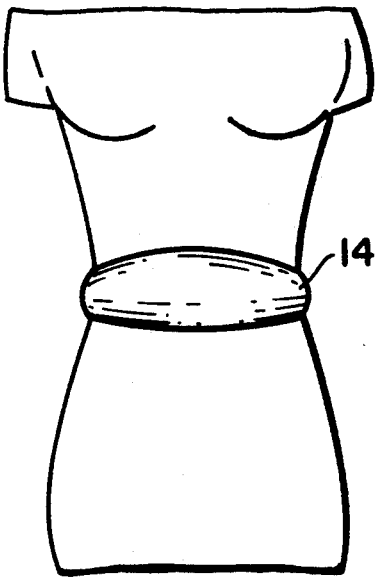
FIG. 2 is an elevational view of the front of a woman wearing a waistband in accordance with a first preferred embodiment of the present invention.

FIG. 2 illustrates a scarf used as a waistband in accordance with a first preferred embodiment of the present invention. In this embodiment, the scarf 14 is spread wide like a cumberbund with the aid of a form which will be described in detail below. This scarf 14 is tied in the back in the manner shown in FIG. 1B.

Figure 3:
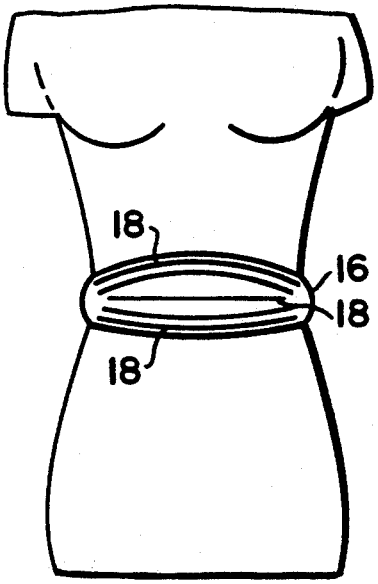
FIG. 3 is an elevational view of the front of a woman wearing a waistband in accordance with a second preferred embodiment of the present invention.

FIG. 3 illustrates a variation on the embodiment of FIG. 2. In the embodiment of FIG. 3, the scarf 16 is provided with horizontal pleats 18.

Whether formed with a smooth shape as shown in FIG. 2, or with pleats as shown in FIG. 3, the present invention spreads wide the scarf at the front of the wearer, thus taking advantage of the decorative designs and colors of the scarf fabric.

Figure 4:
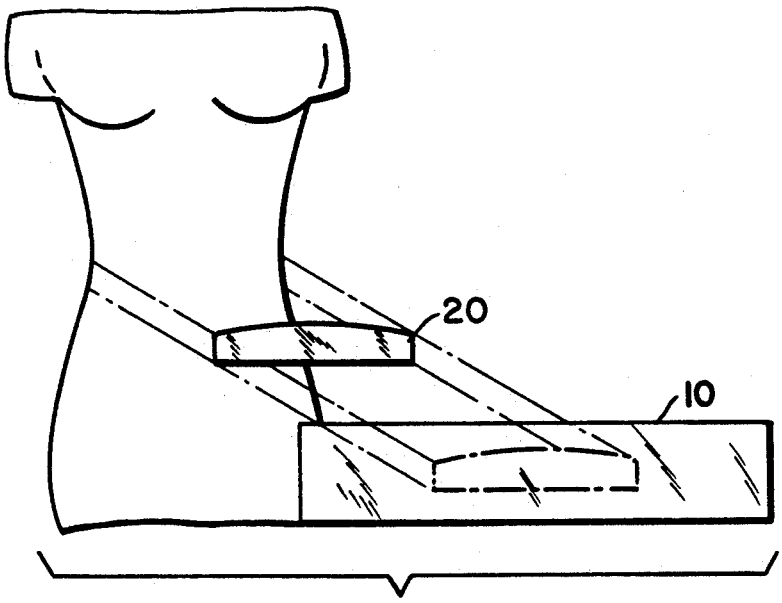
FIG. 4 is an assembly diagram showing the separate parts of the waistband illustrated in FIG. 2.

The width of the scarf at the front of the wearer is maintained by wrapping the scarf about a separate, semi-rigid form made of flexible sheet material. FIG. 4 shows how this form is placed between the scarf and the waistline of the wearer.

Figure 5A:
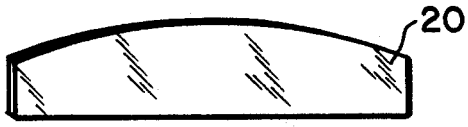
FIGS. 5A, 5B and 5C illustrate three different forms which may be used with the waistband according to the present invention.
Figure 5B:
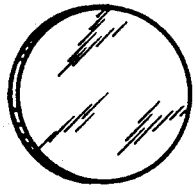
Figure 5C:
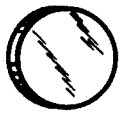

The form may take on a variety of shapes and sizes as illustrated in FIGS. 5A, 5B and 5C. FIG. 5A shows a conventional form suitable for maintaining the scarf in the widened positions indicated in FIGS. 2 and 3. FIGS. 5B and 5C are disk shaped forms, large and small, respectively, which may be used to produce different effects, as will be explained below in connection with FIGS. 8–11

Figure 6:
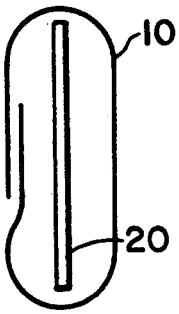
FIG. 6 is a cross-sectional view showing how a scarf is wrapped around a form when in use as a waistband.

FIG. 6 shows how a scarf 10 may be wrapped about a form 20 to maintain a desired position and shape. As may be seen, the scarf is simply folded over the form and tucked in behind it prior to tying the scarf around the waist of the wearer.

Figure 7A:
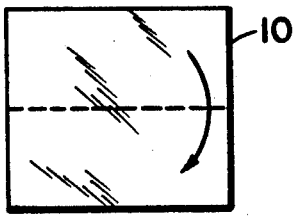
FIGS. 7A and 7B are elevational views illustrating how a scarf may be folded to form a waistband in accordance with the present invention.
Figure 7B:
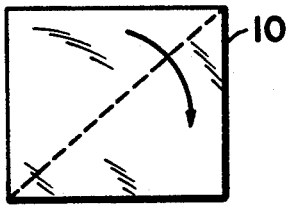

The original shape of the scarf may be that of a band, as shown in FIG. 4, or the scarf may be square. In the latter case, the scarf should be initially folded in two to form a band, either along a mid-line as shown in FIG. 7A or along a diagonal as shown in FIG. 7B.

Figure 8:
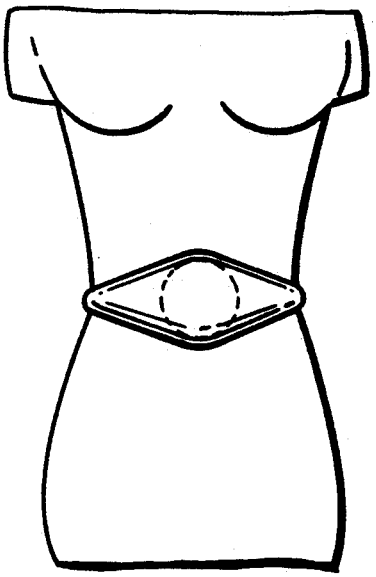
FIG. 8 is an elevational view of the front of a woman wearing a waistband in accordance with a third preferred embodiment of the present invention.
Figure 9:
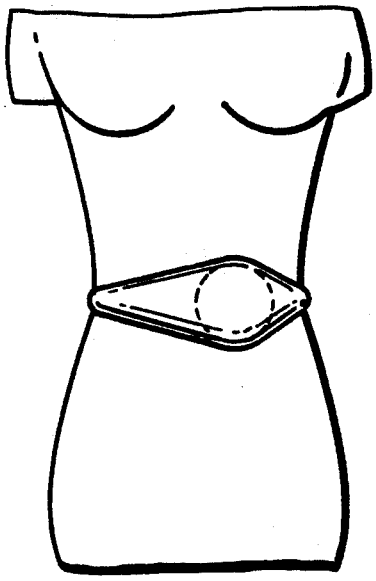
FIG. 9 is an elevational view of the front of a woman wearing a waistband in accordance with a fourth preferred embodiment of the present invention.
Figure 10:
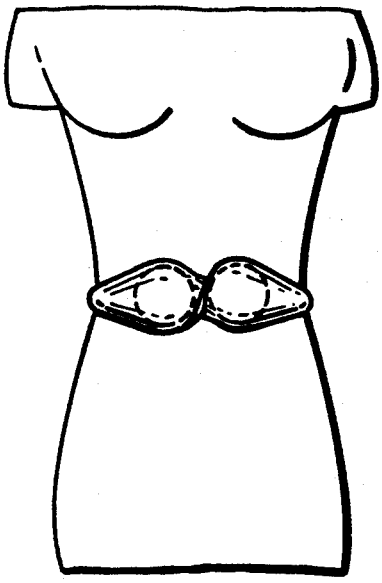
FIG. 10 is an elevational view of the front of a woman wearing a waistband in accordance with a fifth preferred embodiment of the present invention.
Figure 11:
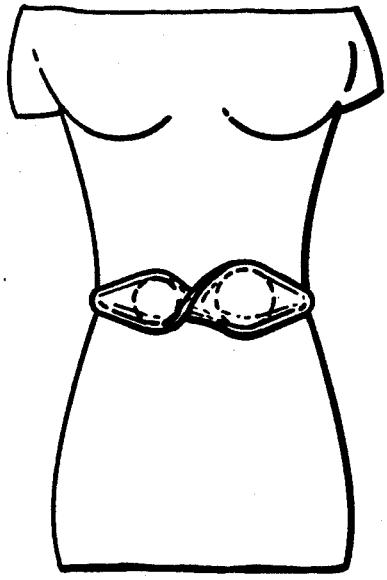
FIG. 11 is an elevational view of the front of a woman wearing a waistband in accordance with a sixth preferred embodiment of the present invention.

FIGS. 8–11 illustrate different styles which may be created using round forms of the type shown in FIG. 5B and FIG. 5C. FIG. 8 shows a "center wrap" with a single large round form arranged front and center of the waist. FIG. 9 shows a "comet wrap", formed by placing a single round form either to the right or left side of the wearer. FIG. 10 shows a "figure eight wrap" using two round forms of the same diameter. FIG. 11 illustrates a variation on the figure eight wrap using two round forms of different diameter.

The methods of wrapping a scarf about a form all begin with the same preparation. The wearer starts by laying an oblong scarf on a flat surface, or by folding a square scarf in half as shown in FIG. 7, and then laying it flat. The different "wraps" are created as follows:

(1) Use of a contoured form (FIG. 5A):

(a) Smooth Wrap: The form is centered on the scarf and the scarf is wrapped smoothly around the form lengthwise. The scarf is grasped near the ends of the form, pulled around the waist and tied in the back.

(b) Pleated Wrap: The scarf is arranged in folds about 12 inches long along its length. The form is laid on the folds and the scarf is grasped near the ends of the form, pulled around the waist and tied in the back. The pleats are then adjusted at the front.

A very long scarf can be crossed at the back and brought around and tied in the front of the wearer.

(2) round forms (FIGS. 5B and 5C):

(a) Center Wrap: The form is placed in the center of the scarf and the scarf folded lengthwise around the form. The scarf is grasped on either side of the form, twisted 180° or 360° on either side of the form and tied in the back. The two twists are made in opposite directions —clockwise on one side and counter clockwise on the other.

(b) Comet Wrap: The form is placed on the scarf about 4½ inches off the center. The scarf is grasped on one side near the form and on the other side about 8 inches away from the form. On the side near the form, the scarf is twisted 360° pulling it around to tie in the back. The long end is just pulled straight around the waist without a twist.

(c) Figure Eight Wrap: The two small forms are placed side by side in the center of the scarf with a 2 inch separation between them. The scarf is folded over the forms and then grasped on either side near the forms. As the scarf is pulled around the waist, it is twisted 360° at the center between the forms; that is, one of the forms is flipped over twice.

Figure 12:
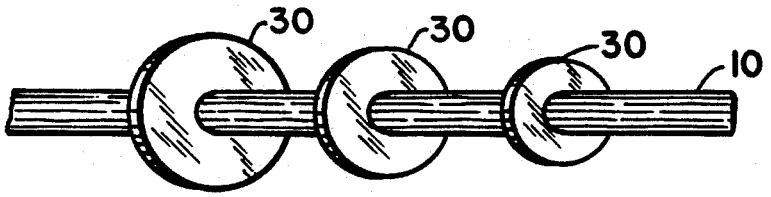
FIG. 12 is an elevational view of a scarf arranged to pass through openings in a plurality of decorative forms for use as a waistband in accordance with a seventh preferred embodiment of the present invention.

FIGS. 12–16 show some variations on the forms for cases where the forms are visible when in use. FIG. 12 shows three annular shaped forms 30 of different sizes, each with a central opening. In this embodiment, the scarf 10 is passed through the openings and then tied around the waist at the back of the wearer.

Figure 13A:
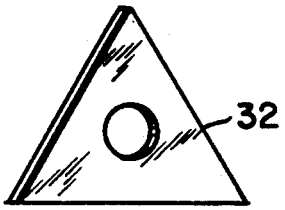
FIGS. 13A and 13B illustrate alternative shapes of the forms which may be used in the waistband embodiment of FIG. 12.
Figure 13B:
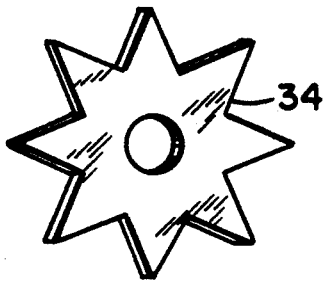

FIGS. 13A and 13B show two alternative shapes of the forms which may be used in the embodiment of FIG. 12. In FIG. 13A the form 32 is triangular in shape in FIG. 13B it is star shaped.

Figure 14:
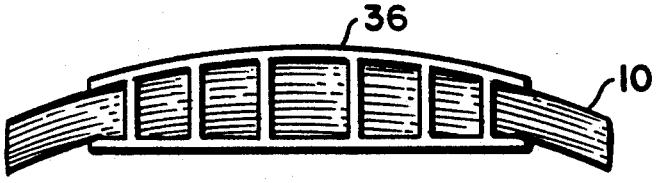
FIG. 14 is an elevational view of a waistband in accordance with an eighth preferred embodiment of the present invention.
Figure 15:
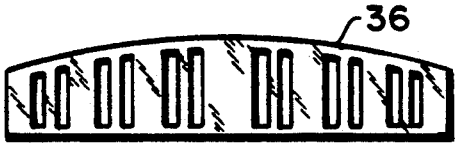
FIG. 15 is an elevational view of the form used in the waistband embodiment of FIG. 14.

FIG. 14 illustrates an embodiment similar to FIG. 2; however in this case, the form 36 (also shown in FIG. 15) is partly visible when the waistband is worn. The scarf 10 is passed in and out through slots in the form 36 to create the effect shown in FIG. 14 and then tied in the back of the wearer.

Figure 16:
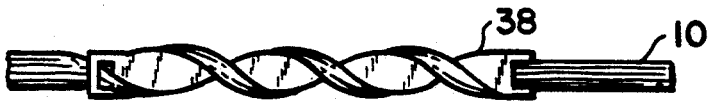
FIG. 16 is an elevational view of a waistband in accordance with a ninth preferred embodiment of the present invention.

FIG. 16 illustrates the use of a twisted form 38 that creates a helical effect with the scarf. In this embodiment, the scarf 10 is passed through slots at opposite ends of the form and follows the twists through the center section of the form.

The forms may be made at any semi-rigid, yet flexible sheet material. Low density polyethylene plastic has been used with success. In cases where the forms are visible, they are preferably manufactured from a decorative material such as leather or gold tone metal or plastic. Preferred colors are frosted white or black. It is also possible to provide two colors on the same form, for example, black on one side and white on the other.

There has thus been shown and described a novel waistband accessory device and wrapping method using a scarf which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A waistband adapted to surround the waist of a wearer as a fashion accessory, said waistband comprising in combination:

(a) a scarf formed of a piece of cloth material having a length sufficient to wrap around a wearer's waist; and (b) at least one semi-rigid form made of flexible sheet material; said scarf being wrapped around said form without sewing such that said scarf takes on a shape defined in part by said form; and wherein, after wearing and removal from a wearer's waist, said parts may be disassembled.

2. The waistband defined in claim 1, wherein said scarf completely covers said form when in use as a waistband.

3. The waistband defined in claim 1, wherein said form has at least one opening and said scarf is passed through said opening when in use as a waistband.

4. The waistband defined in claim 3, wherein said form has a plurality of openings through which said scarf is passed when in use as a waistband.

5. The waistband defined in claim 1, wherein said scarf has an increased waistband width where its shape is defined by said form.

6. The waistband defined in claim 1, wherein said form is circular in shape.

7. The waistband defined in claim 1, wherein said form comprises a plurality of separate, semi-rigid form elements made of flexible sheet material.

8. The waistband defined in claim 7, wherein said form elements are identical in shape and size.

9. The waistband defined in claim 8, wherein said form elements are circular in shape.

10. A method of forming a waistband around the waist of a wearer as a fashion accessory, said waistband comprising the following separate, individual parts:

(a) a scarf formed of a piece of cloth material having ends; and (b) at least one semi-rigid form made of flexible sheet material;

said method comprising the steps of:

(1) prior to wearing, wrapping said scarf about at least a portion of said form without sewing;

(2) surrounding the waist with said scarf and form such that the form is positioned at substantially the midsection of the wearer;

(3) connecting the ends of the scarf together to form a waistband around the wearer, said scarf taking on a shape defined in part by said form; and (4) after wearing, removing the scarf and form from the wearer's waist and disassembling said individual parts.

11. The method defined in claim 10, wherein said scarf is wrapped around the entire form thereby completely covering said form.

12. The method defined in claim 10, wherein said form has at least one opening and wherein said scarf is passed through said opening.

13. The method defined in claim 12, wherein said form has a plurality of openings and wherein said scarf is passed through at least two of said openings.

14. The method defined in claim 10, wherein said scarf takes on an increased waistband width where its shape is defined by said form.

15. The method defined in claim 10, wherein said ends of said scarf are connected by tying.

16. The method defined in claim 15, wherein said ends of said scarf are tied at the back of the wearer.

* * * * *